United States Patent [19]

Camp et al.

[11] 3,954,533

[45] May 4, 1976

[54] HIGH PRESSURE-BURNING PROPELLANT COMPOSITION

[75] Inventors: Albert T. Camp, Indian Head, Md.; Elmer R. Csanady, Washington, D.C.

[73] Assignee: The United States of America as represented by the Secretary of the Navy, Washington, D.C.

[22] Filed: Oct. 29, 1969

[21] Appl. No.: 872,434

[52] U.S. Cl. ..... 149/98; 149/92; 149/102

[51] Int. Cl.[2] ..... C06B 25/26

[58] Field of Search ..... 149/38, 102, 98, 92

[56] References Cited

UNITED STATES PATENTS

| | | | |
|---|---|---|---|
| 2,982,638 | 5/1961 | Cooley et al. | 149/98 |
| 3,032,972 | 5/1962 | Preckel | 149/98 X |
| 3,088,858 | 5/1963 | Camp | 149/98 X |
| 3,102,834 | 9/1963 | Camp et al. | 149/98 X |
| 3,103,458 | 9/1963 | Besser et al. | 149/98 |
| 3,228,815 | 1/1966 | Henry et al. | 149/98 |
| 3,450,583 | 6/1969 | Chaille et al. | 149/98 X |

*Primary Examiner*—Stephen J. Lechert, Jr.

[57] ABSTRACT

Double-base propellant compositions of the plateau and/or mesa type which are comprised of ballistic modifiers of lead and copper salts of acetamidobenzoic acids, acetamidosalicylic acids, and resorcylic acids.

8 Claims, 6 Drawing Figures

Albert T. Camp
Elmer R. Csanady
INVENTORS

BY J. O. Tresansky
ATTORNEY

HIGH PRESSURE-BURNING PROPELLANT COMPOSITION

BACKGROUND OF THE INVENTION

This invention relates generally to gas producing charges and more particularly to double base propellants exhibiting very low dependence of burning rates on conditioned temperature and also exhibiting plateau and/or mesa burning rate behavior at high burning rates and pressures.

Relatively recently, a great deal of interest has emerged in the development of plateau and mesa type propellants. These propellants are characterized by an unusual pressure-burning rate relationship, this relationship defining the plateau and mesa characteristics. The pressure-burning rate relationship is defined by the slope $n$, or pressure exponent, of the curve produced by the logarithmic graph of the burning rate of propellant plotted against pressure. This relationship, i.e. between the pressure at which a propellant burns and its burning rate is mathematically expressed as $r = cp^n$ where $r$ is the burning rate, $p$ is the pressure and $c$ and $n$ are constants characteristic of the particular propellant. The equation can be reexpressed as $\log r = n \log p + \log c$. Thus, a plot of $\log r$ against $\log p$ for a conventional propellant gives a straight line which has a slope $n$, i.e., representative of a progressive increase in burning rate for each increase in pressure. However, in the case of plateau type propellants, the pressure exponent $n$ becomes zero in a certain region of pressure. Such propellants at a given temperature give a steady burning rate within the region and, consequently, a steady thrust. In the case of mesa type propellants the pressure exponent $n$ is negative in certain regions of pressure so that the burning rate decreases slightly with increasing pressure. There are a number of well known advantages to propellants exhibiting this "plateau" and "mesa" phenomena. For example, with conventional double base propellants, pressures build up rapidly and a thick-walled chamber is needed to contain the propellant tending to make rockets thus powered heavy and poor in ballistic performance. This disadvantage is overcome by the plateau and mesa type propellants. Further, in the case of mesa type propellants, there is an inherent tendency for overlapping of rate-pressure relationships at various temperatures as illustrated by logarithmic graphs of the relationships, that is, in certain regions of pressure the burning rate of a propellant for firings at low temperature may be actually higher than the burning rate for firings at high temperature. Additionally, the variation in performance with change in temperature for mesa type propellants is negligible and in some cases there is none at all. Examples of such mesa type propellants which possess this further advantage, that is, burning rates which are substantially temperature insensitive over wide ranges of operating pressures are described in U.S. Pat. No. 3,138,499 by Camp et al. In light of the above described desirable characteristics of plateau and mesa type propellants, it has now become desirable to further augment these advantages by formulating propellants which exhibit plateau and/or mesa regions at very high useable pressures and, concomitantly, exhibit very fast burning rates. Such propellants will provide for higher specific impulses and, in view of the fast burning rates, will allow greater efficiency and easier handling of, for example, rocket launchers and other combat weapons.

These plateau and mesa phenomena are due to the substitution of certain amounts of ballistic modifier compounds for the nitroglycerin and nitrocellulose of the basic propellant formulation. Due to the high calorific values attributed to nitrocellulose and nitroglycerin the greater the substitution for these materials with ballistic modifiers (in order to attain higher operating pressures) the lower becomes the heat of explosion of the mixture. It is therefore also desirable to provide more efficient plateau and mesa type propellants, that is those which utilize less ballistic modifier, yet which provide for higher useable operating pressures.

In addition to the above desirable properties which are characteristic of plateau and mesa type propellants, a suitable propellant should possess other requisite properties. For example, it should have good storage stability characteristics and should lend itself readily to a feasible mass production process.

SUMMARY OF THE INVENTION

It is therefore one object of this invention to provide improved double base propellants of the mesa and plateau type.

It is another object of this invention to provide double base propellants of the mesa and plateau type which exhibit their mesa and plateau characteristics at higher operable pressures than heretofore attained.

It is still another object of this invention to provide double base propellants of the mesa and plateau type which are more efficient, that is, utilize smaller amounts of ballistic modifiers, yet provide higher operable pressures, than heretofore attained.

It is a further object of this invention to provide double base propellants of the mesa and plateau type which are substantially performance temperature insensitive and which also possess good storage stability characteristics.

These and other objects are accomplished by a nitrocellulose-nitroglycerin double base propellant to which is added, in addition to the usual plasticizers and stabilizers, ballistic modifiers comprising lead and copper salts of certain aromatic and heterocyclic acids.

DESCRIPTION OF THE PREFERRED EMBODIMENTS

Figure 1:
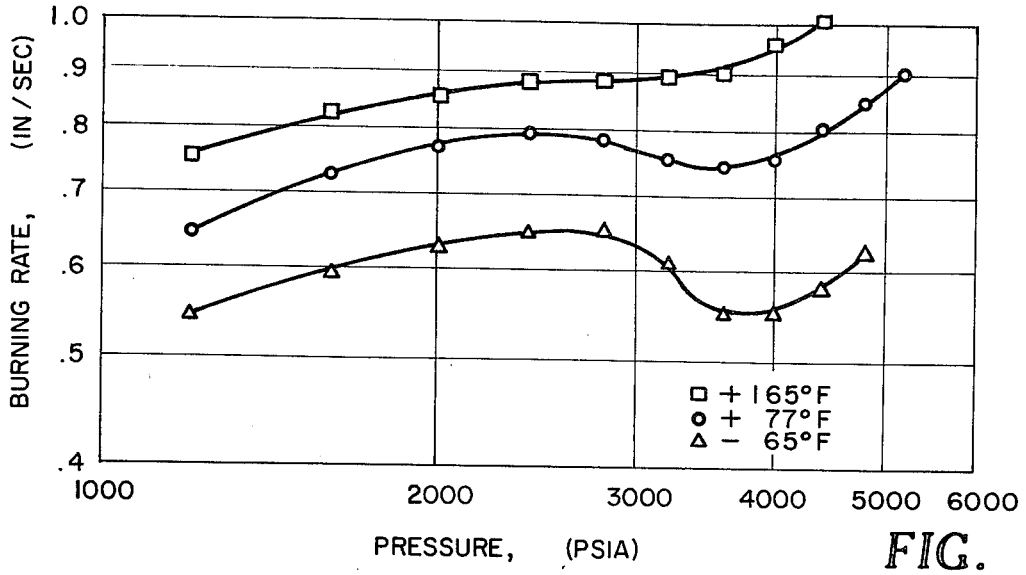
FIGS. 1–6 of the drawings are graphs illustrating the pressure-burning rate relationships for the various propellants tested.

Ballistic modifiers which particularly lend themselves to be incorporated in the double base propellants of this invention are the lead (preferably divalent) and copper salts (preferably cupric) of o-hydroxynicotinic acid, the lead and copper salts of amido-substituted benzoic acids having the general formula (I)

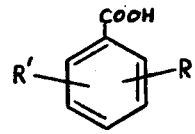

(I)

wherein R is $$-N-\overset{O}{\overset{\|}{C}}-R'',$$

R′ is $$-N-\overset{O}{\overset{\|}{C}}-R''$$

or H, and R″ is alkyl of 1–4 carbons, the lead (preferably divalent) and copper salts (preferably cupric) of amido-substituted salicyclic acids having the general formula (II)

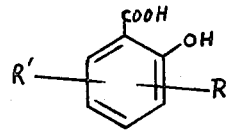

(II)

wherein R and R′ have the same significance as above and mixtures thereof, either alone or in combination with a copper salt (preferably cupric) of an acid selected from the group consisting of beta-resorcylic acid, salicylic acid, 2,5 dihydroxybenzoic acid, and 5-methylene disalicylic acid provided that the total ballistic modifier component employed be comprised of at least one lead salt and one copper salt of different acid moieties. Moreover, the normal or monobasic form of all the above enumerated salts may be utilized for the purposes of this invention.

Acids of particular suitability represented by the general formula (I) are for example, 2,4-diacetamidobenzoic acid, 2,5-diacetamidobenzoic acid, 2-acetamidobenzoic acid and 4-acetamidobenzoic acid, while acids represented by general formula (II) are for example, 4-acetamidosalicylic acid and 5-acetamidosalicylic acid. The preferred amount of modifier added to the propellant composition ranges from about 0.5 to about 3.5 percent by weight for each lead and copper salt. The total modifier component should not be less than about 1.0 percent by weight and not more than about 10 percent by weight.

In addition to the afore-identified modifiers, the propellant should have the following approximate composition: nitrocellulose 40–60 percent by weight, nitroglycerin 30–40 percent by weight, plasticizer 0–10 percent by weight, stabilizer 1–3 percent by weight. The plasticizer used may be a phthalate, adipate, sebacate, glycol or glycerol ester, all well known in the art. Suitable stabilizers are derivatives of urea, diphenylamine and aniline, all of which are also well known in the art. The plasticizers and stabilizers employed, however, must be substantially non-volatile. Di-n-propyladipate (DNPA) is a preferred plasticizer while 2-nitrodiphenylamine is a preferred stabilizer.

Additionally, compatible metal fuels such as aluminum, zirconium or beryllium may be added to the propellant to raise the heat of explosion of the mixture. The amount of metal fuel employed may range, therefore, from zero to about 10 percent by weight.

The propellants of this invention as hereinbefore described may be made by any of the well known conventional procedures. The solventless procedure described in U.S. Pat. No. 3,138,499 by Camp et al. for making propellants of this type is one such method. Candelilla wax may also be added in minute amounts to the propellant compositions of this invention to enhance the extrusion properties thereof.

Having generally described the invention the following examples are given for purposes of illustration. It will be understood that the invention is not limited to these examples, but is susceptible to different modifications which will be recognized by one of ordinary skill in the art.

Example 1

| Component | Weight Percent |
|---|---|
| Nitrocellulose (12.6% N) | 49.0 |
| Nitroglycerin | 39.4 |
| Dinitro-di-n-propyl adipate | 7.5 |
| 2-nitro-diphenylamine | 2.0 |
| Lead 2-acetamidobenzoic acid | 1.0 |
| Monobasic cupric β-resorcylate | 1.0 |
| Candelilla wax | 0.1 |

The composition had a measured heat of explosion of 945 cal/g. The burning rate curve of the composition of Example 1 is shown in FIG. 1 of the drawings. The composition is substantially temperature insensitive as evidenced by a temperature coefficient ($\pi_k$) of 0.14. The mesa region for the composition is observed at about 2800 to about 4000.

Example 2

| Component | Weight Percent |
|---|---|
| Nitrocellulose (12.6% N) | 49.0 |
| Nitroglycerin | 39.4 |
| Dinitro-di-n-propyl adipate | 7.5 |
| 2-nitro-diphenylamine | 2.0 |
| Lead 4-acetamidosalicylic acid (normal) | 1.0 |
| Monobasic cupric β-resorcylate | 1.0 |
| Candelilla wax | 0.1 |

Figure 2:
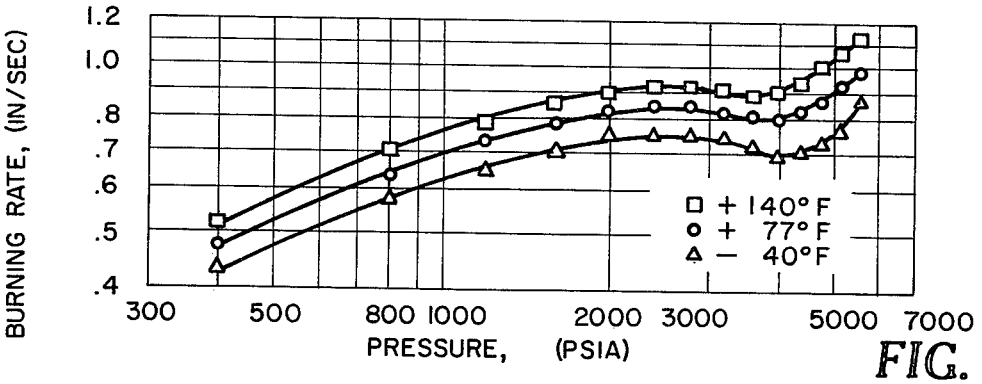

The composition of Example 2 had a measured heat of explosion of 939 cal/g. FIG. 2 shows the burning rate curves of this composition. As illustrated by FIG. 2, the composition shows very little temperature sensitivity from about 400 to about 6000 psi and exhibits a mesa region at about 2800 to about 4000 psi with an operable pressure range of from about 1000 to about 4000 psi and burning rate range of from about 0.7 to 0.9 inches per second.

Example 3

| Component | Weight Percent |
|---|---|
| Nitrocellulose (12.2% N) | 49.0 |
| Nitroglycerin | 39.4 |
| Dinitro-di-n-propyl adipate | 7.5 |
| 2-nitro-diphenylamine | 2.0 |
| Lead 4-acetamidosalicylic acid (normal) | 1.0 |
| Monobasic cupric β-resorcylate | 1.0 |
| Candelilla wax | 0.1 |

Figure 3:
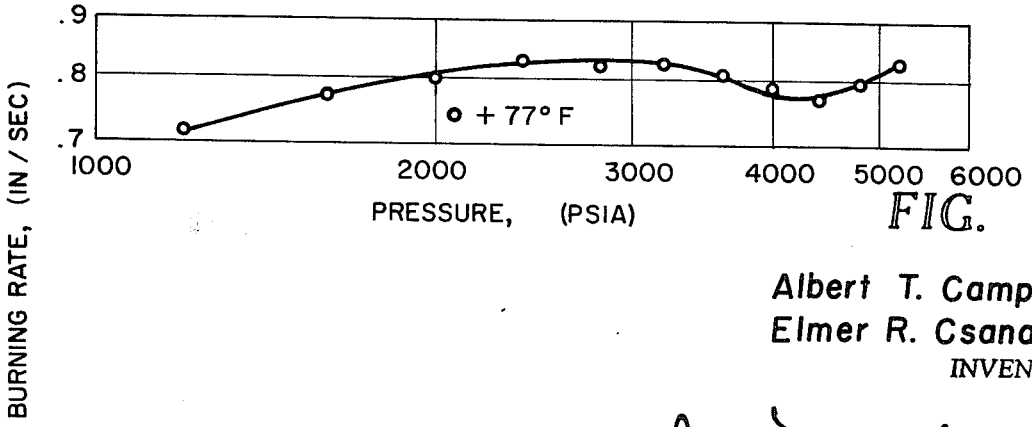

The composition of Example 3 had a measured heat of explosion of 894 cal/g. The burning rate curve of this composition is plotted in FIG. 3 which illustrates a mesa region of about 3300 to about 4500 psi and burning rate of about 0.75 inches per second.

| Component | Weight Percent |
|---|---|
| Nitrocellulose (12.6% N) | 49.0 |
| Nitroglycerin | 39.4 |
| Dinitro-di-n-propyl adipate | 7.5 |

-continued

| Component | Weight Percent |
|---|---|
| 2-nitro-diphenylamine | 2.0 |
| Lead 5-acetamidosalicylic acid (normal) | 1.0 |
| Monobasic cupric β-resorcylate | 1.0 |
| Candelilla wax | 0.1 |

Figure 4:
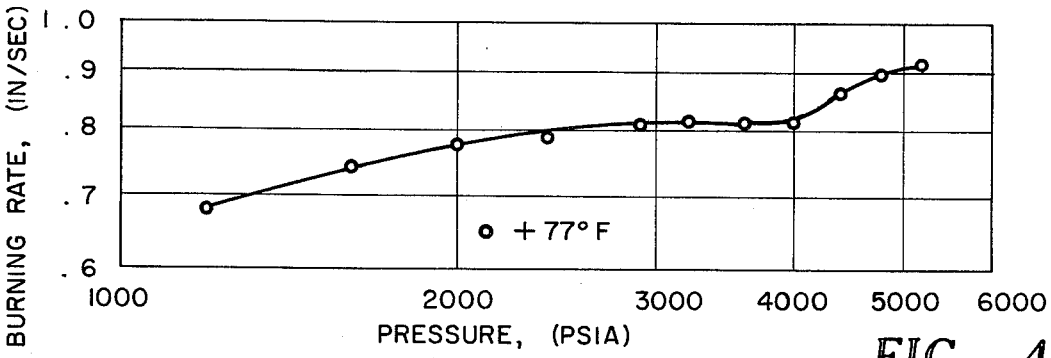

The composition of Example 4 had a measured heat of explosion of 904 cal/g. The burning rate curve of the composition is plotted in FIG. 4. A mesa region is exhibited at about 3500 to about 4000 psi and about 0.75 inches per second burning rate.

Example 5

| Component | Weight Percent |
|---|---|
| Nitrocellulose (12.6% N) | 49.0 |
| Nitroglycerin | 39.4 |
| Dinitro-di-n-propyl adipate | 5.5 |
| 2-nitro-diphenylamine | 2.0 |
| Lead 2-acetamidobenzoic acid | 2.0 |
| Monobasic cupric β-resorcylate | 2.0 |
| Candelilla wax | 0.1 |

Figure 5:
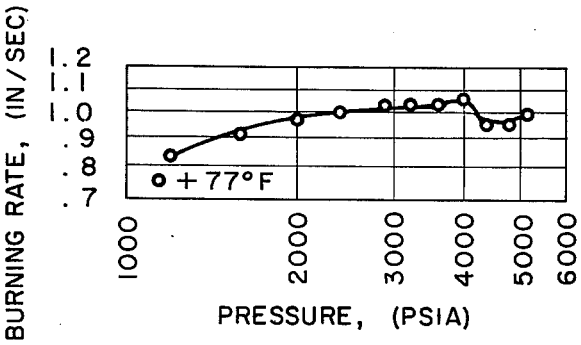

The composition of Example 5 had a measured heat of explosion of 943 cal/g. FIG. 5 shows the burning rate curve for the composition and illustrates the mesa region at about 4000 to about 4500 psi and about 0.95 burning rate.

Example 6

| Component | Weight Percent |
|---|---|
| Nitrocellulose (12.6% N) | 49.0 |
| Nitroglycerin | 39.4 |
| Dinitro-di-n-propyl adipate | 7.0 |
| 2-nitro-diphenylamine | 2.0 |
| Lead 2-acetamidobenzoic acid | 2.0 |
| Monobasic cupric β-resorcylate | 0.5 |
| Candelilla wax | 0.1 |

Figure 6:
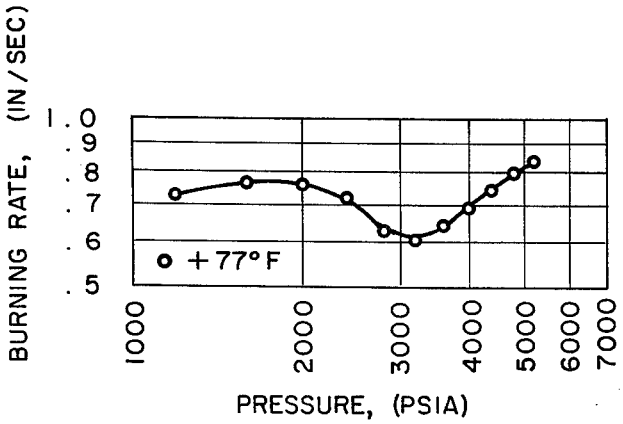

The composition of Example 6 had a measured heat of explosion of 892 cal/g. The burning rate curve for the composition is plotted in FIG. 6 and illustrates the mesa region at about 2000 to about 3300 psi and a burning rate of about 0.6 inches per second.

The data obtained from the compositions of Examples 1–6, as depicted by the burning rate vs. pressure curves of FIGS. 1–6, illustrates the high efficiency of the present compositions. Thus, while the propellant compositions of this invention generally employ only about fifty percent as much ballistic modifier as do the prior art compositions, remarkably higher operable pressures and faster burning rates are attained. Although, it is not fully known why the ballistic modifiers of the present invention enhance the properties of the propellants to such a high degree, it is believed that this enhancement is due to the exceptionally high ultra-violet absorptive capabilities of these compounds.

The heat of explosions and the data for the curves of the pressure-burning rate relationships were obtained by standard techniques similar to those described in the above-identified Camp et al. patent.

Having described the invention, what is claimed as new and desired to be secured by Letters Patent is:

1. A propellant composition comprising nitrocellulose, nitroglycerin and a ballistic modifier which is comprised of at least one lead salt and at least one copper salt of a different acid moiety; wherein said lead salt is selected from the group consisting of a lead salt of o-hydroxynicotinic acid, a lead salt of an amidobenzoic acid having the general formula

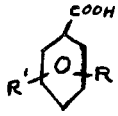

wherein R is $$-N-\overset{O}{\overset{\|}{C}}-R'',$$

R′ is $$-N-\overset{O}{\overset{\|}{C}}-R''$$

or H, and R″ is alkyl of 1 to 4 carbons, and a lead salt, in normal or monobasic form, of an amidosalicylic acid having the general formula

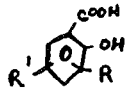

wherein R is $$-N-\overset{O}{\overset{\|}{C}}-R''$$

R′ is —N—C—R″ or H, and R″ is alkyl of 1 to 4 carbons; and wherein said copper salt is selected from the group consisting of a copper salt of o-hydroxynicotinic acid, a copper salt of an amidobenzoic acid having the general formula

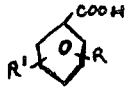

wherein R is $$-N-\overset{O}{\overset{\|}{C}}-R'',$$

R′ is $$-N-\overset{O}{\overset{\|}{C}}-R''$$

or H, and R″ is alkyl of 1 to 4 carbons, a copper salt, in normal or monobasic form, of an amidosalicylic acid having the general formula

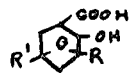

wherein R is

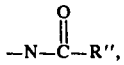

R′ is

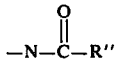

or H, and R″ is alkyl of 1 to 4 carbons, a copper salt, in normal or monobasic form, of betaresorcylic acid, a copper salt, in normal or monobasic form, of salicylic acid, a copper salt, in normal or monobasic form, of 2,5 dihydroxybenzoic acid and a copper salt, in normal or monobasic form, of 5 methylene disalicylic acid.

2. The propellant composition of claim 1 wherein the ballistic modifier is comprised of a lead salt, of an amidobenzoic acid having the general formula

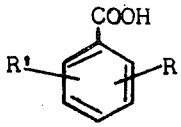

wherein R and R′ are the same as defined in claim 1 and a copper salt of an acid selected from the group consisting of beta-resorcylic and salicylic.

3. The propellant composition of claim 1 wherein the ballistic modifier is comprised of a lead salt, in normal or monobasic form, of an amidosalicylic acid having the general formula

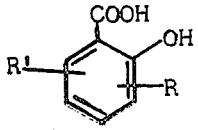

wherein R and R′ are the same as defined in claim 1 and a copper salt, in normal or monobasic form, of an acid selected from the group consisting of beta-resorcylic and salicylic.

4. The propellant composition of claim 1 wherein said nitrocellulose is present in amounts within the range of from about 40 to about 60 weight percent, said nitroglycerin is present in amounts within the range of from about 30 to about 45 weight percent and the total ballistic modifier is present in amounts within the range of from about 1 to about 10 weight percent.

5. The propellant composition of claim 1 wherein each lead and copper salt is present in the same or different amounts within the range of from about 0.5 to about 3.5 percent.

6. The propellant of claim 1 in which has been incorporated a metal fuel selected from the group consisting of aluminum, zirconium and beryllium.

7. The propellant composition of claim 2 wherein said lead salt of an amidobenzoic acid is selected from the group consisting of lead 2-acetamidobenzoic acid, lead 4-acetamidobenzoic acid, lead 2,4-diacetamidobenzoic acid and lead 2,5-diacetamidobenzoic acid and said copper salt of an acid is monobasic cupric beta-resorcylate.

8. The propellant composition of claim 3 wherein said lead salt of an amidosalicylic acid is selected from the group consisting of lead 4-acetamidosalicylic acid and lead 5-acetamidosalicylic acid and said copper salt of an acid is monobasic cupric beta-resorcylate.

* * * * *